US008365355B2

(12) United States Patent
Liu

(10) Patent No.: US 8,365,355 B2
(45) Date of Patent: Feb. 5, 2013

(54) ROCKING DOORSTOP

(76) Inventor: Corey Yuping Liu, San Mateo, CA (US)

( * ) Notice: Subject to any disclaimer, the term of this patent is extended or adjusted under 35 U.S.C. 154(b) by 0 days.

(21) Appl. No.: 12/793,815

(22) Filed: Jun. 4, 2010

(65) Prior Publication Data

US 2011/0296650 A1 Dec. 8, 2011

(51) Int. Cl.
*E05F 5/02* (2006.01)

(52) U.S. Cl. ..... 16/82

(58) Field of Classification Search ..... 16/82, 86 A, 16/86 R; 292/288, 342–343, DIG. 15
See application file for complete search history.

(56) References Cited

U.S. PATENT DOCUMENTS 290,526 A * 12/1883 Bulger ..... 292/344
394,709 A * 12/1888 Mitchell, Jr. ..... 292/344
1,664,174 A * 3/1928 Hoopes, Jr. ..... 292/344
2,120,692 A * 6/1938 Butts ..... 292/343
2,172,610 A * 9/1939 Frank ..... 292/288
2,709,615 A * 5/1955 Barnes, Jr. et al. ..... 292/339
2,798,755 A * 7/1957 Zapotocny ..... 292/342
2,807,490 A * 9/1957 Stachura ..... 292/288
3,706,112 A * 12/1972 Newell ..... 16/82
5,291,631 A * 3/1994 Schjoneman ..... 16/86 R
D347,570 S * 6/1994 Burge ..... D8/402
6,041,473 A * 3/2000 Johnson ..... 16/82
D588,448 S * 3/2009 Lagerstedt ..... D8/402

* cited by examiner

*Primary Examiner* — Victor Batson
*Assistant Examiner* — Matthew Sullivan
(74) *Attorney, Agent, or Firm* — Ray K. Shahani, Esq.; Kin Hung Lai

(57) ABSTRACT

The invention is a mechanical device that fixes a door in an open or partially open position, preventing the door from closing as a result of wind or incidental tugging. The invention does not require permanent attachment to the door or doorframe and can be readily applied or removed from the door. And the rocking doorstop prevents the door from moving in either direction.

11 Claims, 4 Drawing Sheets rocks left & right

ROCKING DOORSTOP

SPECIFICATION OF THE INVENTION

Figure 1:
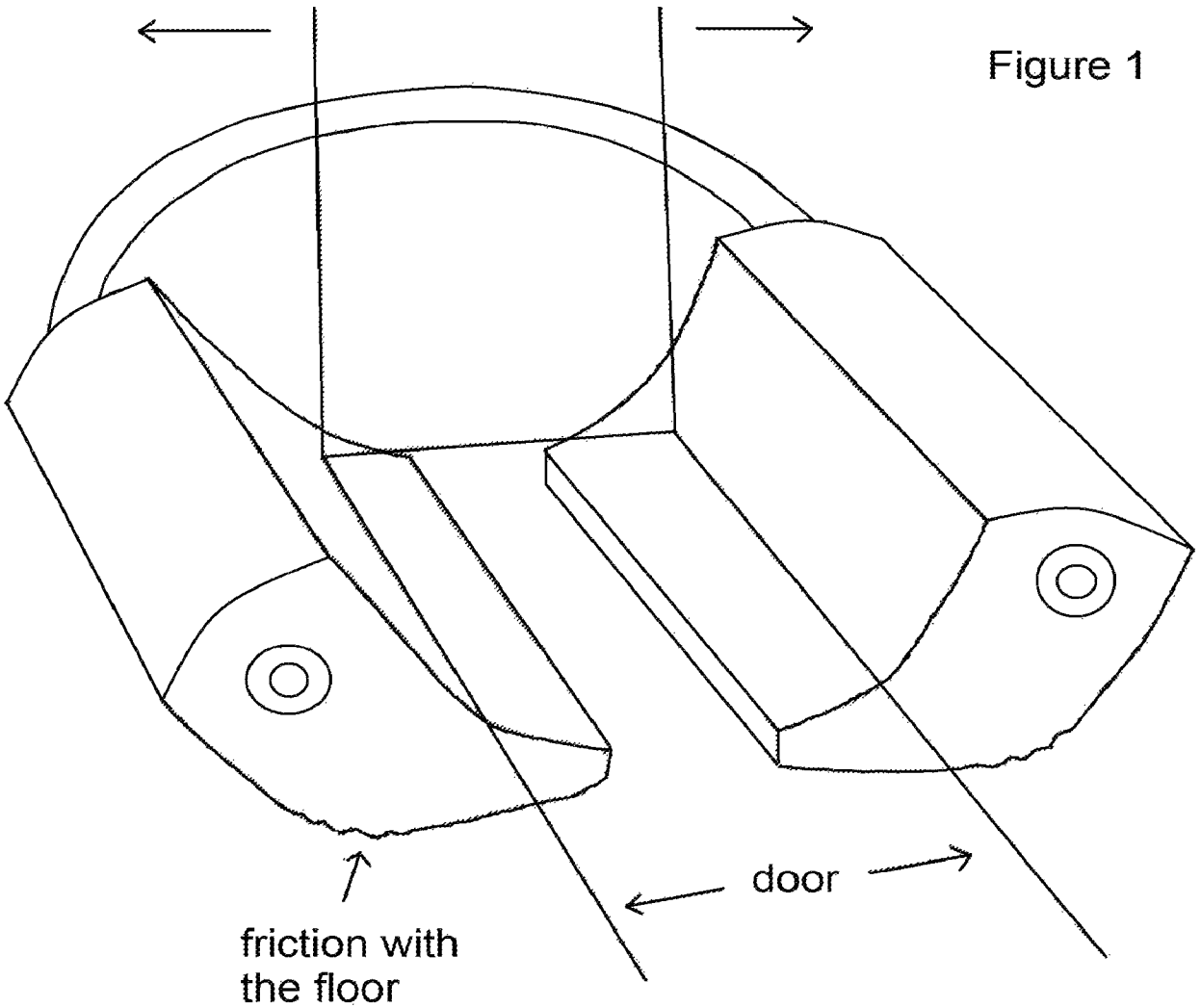

The rocking doorstop is designed to fit around the lower corner edge of an open door as shown in FIG. 1. Its shape and design is depicted in FIG. 1. When manufactured, the dimensions, exact shape, and proportions can be adjusted from what is shown in FIG. 1, so that the final manufactured design will accommodate a broad range of doors or to accommodate specific types of doors and door installations. One possibility is to make the overall length of rocking doorstop shorter in order to conserve on size and material. Another possibility is to make various parts of the cross section thicker or thinner to produce a more pronounced or more immediate wedging action and more friction to the floor.

Figure 2:
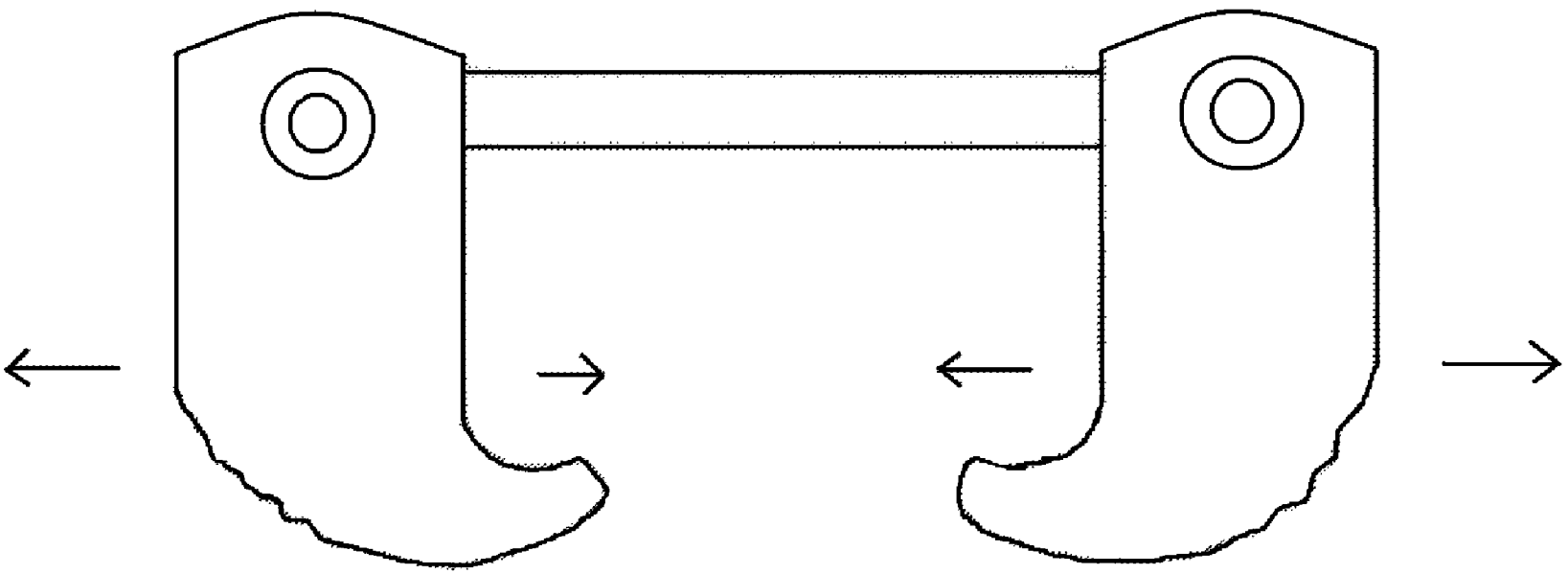
Figure 3:
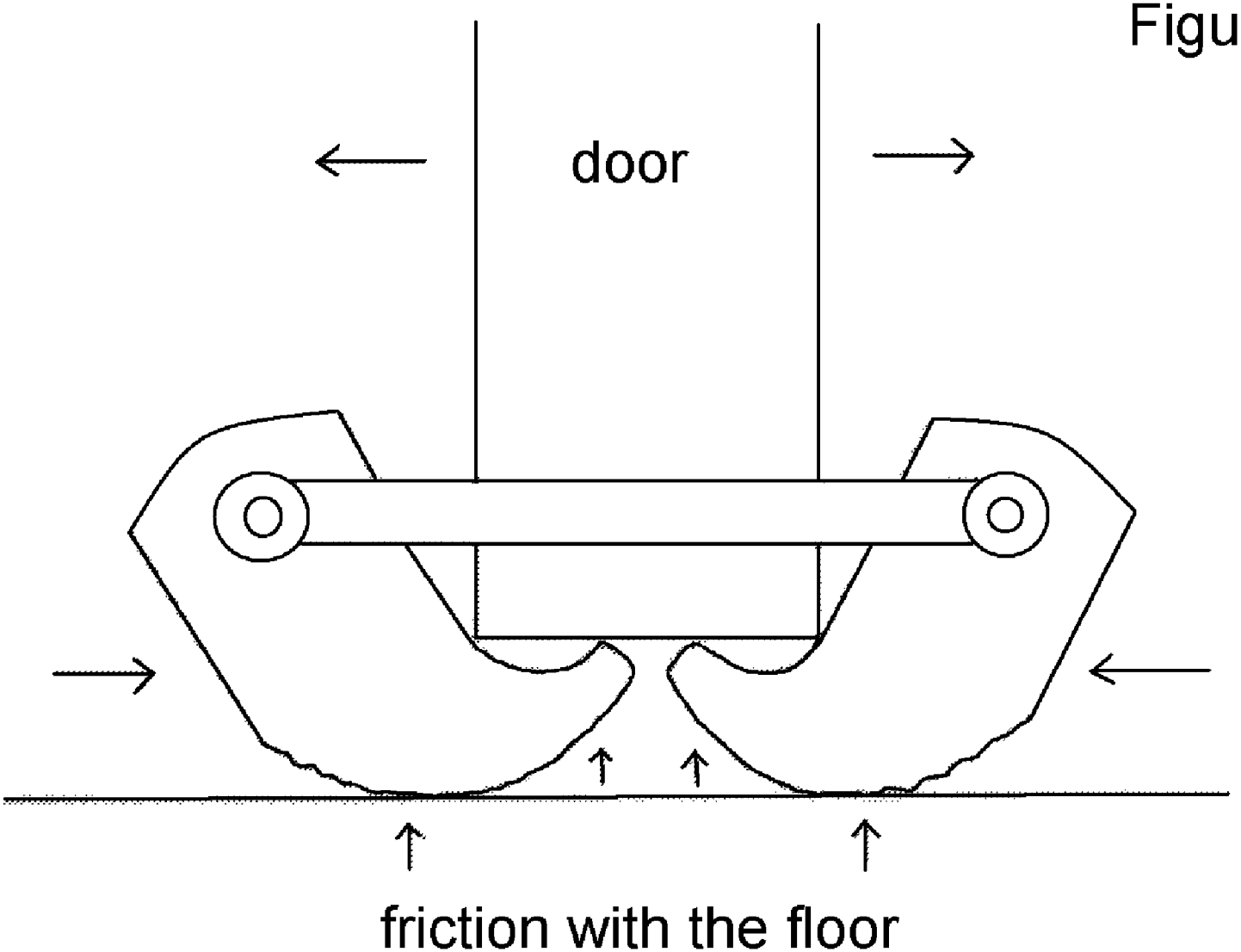
Figure 4:
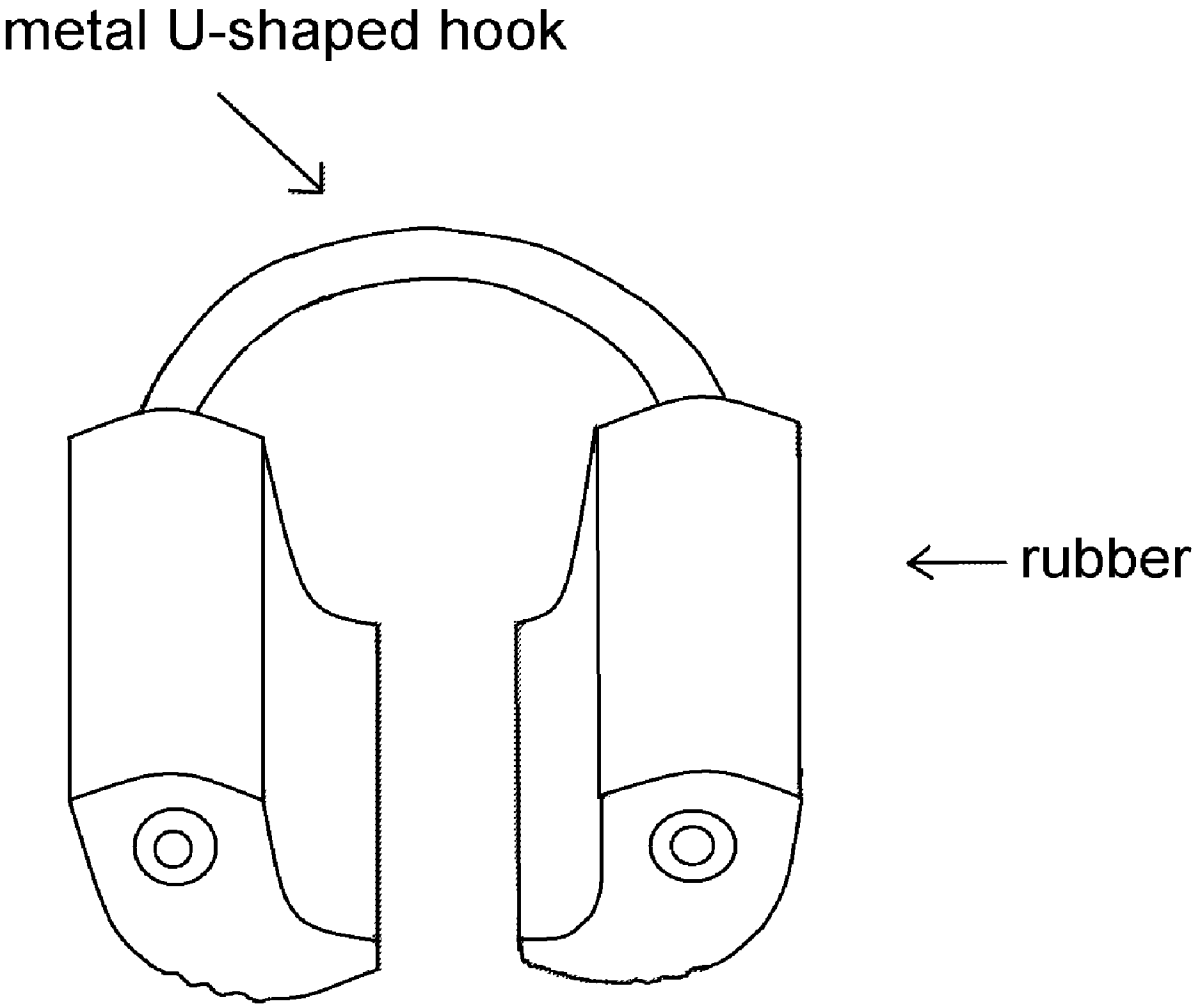

A metal u-shaped hook as shown in FIGS. 1 and 4, allows for easy removal of rocking doorstop from a door. The u-shaped hook also allows for the two facing stopper wedges to pivot and rock freely as shown in FIGS. 2 and 3. When the rocking doorstop is placed under a door, the pivoting element produces a stopping action similar to the effect shown in FIG. 3.

Various surfaces on the rocking doorstop can be textured and grooved to increase friction. Such surfaces include the outside rolling edge as shown in FIG. 2 or the inside surface enveloping the door.

The rocking doorstop could be constructed from hard to soft materials including rubber and plastic. A slightly soft and compressible rubber appears to be the ideal material.

The invention claimed is:

1. A portable rocking doorstop designed to fit around and protrude past a lower corner, side edge of an open or partially open door, the portable rocking doorstop comprising:

A rigid, U-shaped hook portion having two parallel arm portions coupled together by a curved portion, the curved portion having an internal diameter somewhat larger than the thickness of an open or partially open door such that the two parallel arm portions of the U-shaped hook portion fit around the side facing edge of the open or partially open side of the door adjacent a bottom edge portion of the door; and Two rotating, wedge-shaped members each having a concave side portion and a convex side portion, one of the rotating wedge-shaped members being pivotally coupled to one of the two parallel arm portions and the other one of the rotating wedge-shaped members being pivotally coupled to the other one of the two parallel arm portions such that the two concave side portions of the two rotating wedge-shaped members face each other, wherein when the U-shaped hook portion of the rocking door stop is placed on the side facing edge of the open or partially open side of the door adjacent a bottom edge portion of the door, the concave side of each wedge member can rotate to positions underneath the door to grip the bottom edge of the door while the convex side can become wedged against the floor beneath the side facing edge of the open or partially open door to prevent swinging movement of the door in either direction and to hold the door open or partially open in any position.

2. The portable rotating doorstop of claim 1 in which the two rotating wedge members both rotate in a plane perpendicular to the plane of the U-shaped hook portion.

3. The portable rotating doorstop of claim 1 in which the rotating wedge-shaped members are made of rubber.

4. The portable rotating doorstop of claim 1 in which the rotating wedge-shaped members are made of plastic.

5. The portable rotating doorstop of claim 1 in which the rotating wedge-shaped members are made of a slightly compressible material.

6. The portable rotating doorstop of claim 1 in which the rotating wedge-shaped members pivot freely about the ends of the parallel arms of the rigid U-shaped hook portion.

7. The portable rotating doorstop of claim 1 in which the rotating wedge-shaped members allow the doorstop to be adjustable for use on doors having different size gaps between the door and floor.

8. The portable rocking doorstop of claim 1, wherein the rigid U-shaped hook portion is made of metal.

9. The portable rocking doorstop of claim 1, wherein the convex side portions of the rotating wedge members are textured for providing firmer grip on a floor.

10. The portable rocking doorstop of claim 1, wherein the convex side portions of the rotating wedge members are grooved for providing firmer grip on a floor.

11. The portable rocking doorstop of claim 1, wherein the rotating wedge members produce a wedging force against the floor that is proportional to the force that is applied against the door.

* * * * *